US006688845B2

(12) United States Patent
Páges Páges

(10) Patent No.: US 6,688,845 B2
(45) Date of Patent: Feb. 10, 2004

(54) ELECTRIC PUMP FOR THE RECIRCULATION OF WATER

(75) Inventor: Josep Páges Páges, Banyoles (ES)

(73) Assignee: Bogemar, S.L., Banyoles (ES)

( * ) Notice: Subject to any disclaimer, the term of this patent is extended or adjusted under 35 U.S.C. 154(b) by 0 days.

(21) Appl. No.: 10/133,674

(22) Filed: Apr. 29, 2002

(65) Prior Publication Data

US 2002/0192071 A1 Dec. 19, 2002

(30) Foreign Application Priority Data

Jun. 15, 2001 (ES) ..... 200101395

(51) Int. Cl.[7] ..... F04D 29/70

(52) U.S. Cl. ..... 415/58.4; 415/121.2; 210/169; 417/424

(58) Field of Search ..... 415/58.4, 58.5, 415/58.3, 58.2, 109, 115, 211, 214; 210/169, 97; 417/424

(56) References Cited

U.S. PATENT DOCUMENTS 3,306,448 A * 2/1967 Baker
3,508,661 A * 4/1970 Diamond et al.
3,513,977 A * 5/1970 Bellinson
3,637,331 A * 1/1972 Smith et al. ..... 417/424
4,454,035 A * 6/1984 Stefan ..... 210/117
5,581,826 A * 12/1996 Edwards ..... 4/507
5,750,022 A * 5/1998 Blake et al. ..... 210/169
6,387,250 B1 * 5/2002 Henkin et al. ..... 210/97

* cited by examiner

*Primary Examiner*—Edward K. Look
*Assistant Examiner*—J. M. McAleenan
(74) *Attorney, Agent, or Firm*—Sughrue Mion, PLLC

(57) ABSTRACT

"Electric pump for the re-circulation of water". It includes a suction chamber (1) connected by a communication conduit (3), as well as a filter vessel (5), into which the water drawn in enters by an open upper inlet (6) and exits by multiple small orifices made in its wall (7) and/or its lower base (8). The communication conduit (3) is arranged at a lower level to that of the filter vessel lower base. Moreover, below the lower base (8) of the filter vessel (5) and the impeller assembly (9) an ample hollow space (16, 17) is arranged and is capable of containing a relatively high volume of water.

Applicable to the re-circulation and filtering of swimming pool water.

5 Claims, 3 Drawing Sheets

1
2
3
4
5
6
7
8
9
10
11
12
13
14
15
16
17
18
19
20
21
23
24
25
26
27
29
30
33
34
35
36
37
38

17
30
31
32
32
31
15
30
16

22
35
29
30
17
18
36
3
13
19
29
30
16
36
15

25
26
17
12
26
26
32
32
26
4'
4'
26
26
16
4

ELECTRIC PUMP FOR THE RECIRCULATION OF WATER

TECHNICAL SECTOR OF THE INVENTION

The present invention refers to an electric pump for the re-circulation and filtering of swimming pool water, of the type including a suction chamber and a pressure chamber, both of which are connected to one another by a communication conduit, the first being provided with a water suction inlet, wherein the swimming pool water to be filtered and impelled enters, and a filter vessel, into which the water drawn in enters by an upper open inlet and exits by multiple small orifices made in its wall and/or lower base, whereas the pressure chamber comprises an impelling assembly, driven by an electric motor, and a water outlet for the filtered and impelled water.

State of the Art

Well-known in the art are multiple embodiments of pumps for the re-circulation of water, such as those described in ES-U 284474, ES-U 291043 and ES-U 9801562 Spanish utility models, in EP 544610 and EP 657602 European patents and in GB 379738 and 500072 British patents. In all of the above, whenever the filter vessel fills up with leaves, papers, plastic or other residues they unfailingly get lodged opposite the orifice of the communication conduit between the suction and pressure chamber and stop up the filter passage in the latter zone adjacent to the perimeter of said orifice, so that the water has to pass laterally by the rest of the filter perimeter, and, of necessity, pass through a narrow crown adjoining the perimeter of the mentioned orifice. This pressure-driven water flow through such a narrow crown produces a loud noise owing to the turbulence originating from the water flow thus increasing the pressure drops and altering the smooth operating of the electric pump.

Likewise, all the known embodiments of this type of pump have the impeller and the electric pump arranged co-axially and with the shaft in horizontal position. Arranged thus, the suction chamber is never completely full of water, as the air drawn in by the sucked-in water tends to form bubbles in the upper zone of said chamber, where the impeller is to be found, which also produces an increase in the operating noise of the electric pump.

These two drawbacks constitute a serious problem in the operating of the electric pumps of this type, especially that produced by the stopping-up of the filter vessel, which is even more blatant in very powerful electric pumps, in which the filter vessel walls become deformed by the pressure and rest on the mouth of the communication orifice between both chambers, resulting in the practical closing off of the water flow.

Another additional drawback is that, for construction purposes, the communication conduit is generally narrow and ends in a narrow cavity in the suction chamber, opposite the impellers, which likewise produces a noise increase in the electric pump.

Explanation of the Invention

The electric pump object of the invention eliminates all the mentioned disadvantages and operates in a very noiseless and efficient way.

Essentially, the electric pump of the invention is characterised in that the said communication conduit between the pressure and suction chamber is arranged on a lower level to that of the lower base of the filter vessel, whereby the mouth of said conduit in the pressure chamber is situated below the mentioned lower base of the filter vessel.

According to another feature of the invention, an ample hollow space is arranged below the lower base of the filter vessel and the impeller assembly and can contain a relatively high volume of water which, once the electric pump has started up for the first time, is permanently housed in said ample hollow space.

According to another feature of the invention, the walls of the pressure chamber body and the filter vessel walls diverge appreciably from one another, determining a wide annular space between both walls for the circulation of the water.

BRIEF DESCRIPTION OF THE DRAWINGS

The attached drawings illustrate, by way of non-limiting example, a preferred embodiment of the electric pump of the invention.

Figure 1:
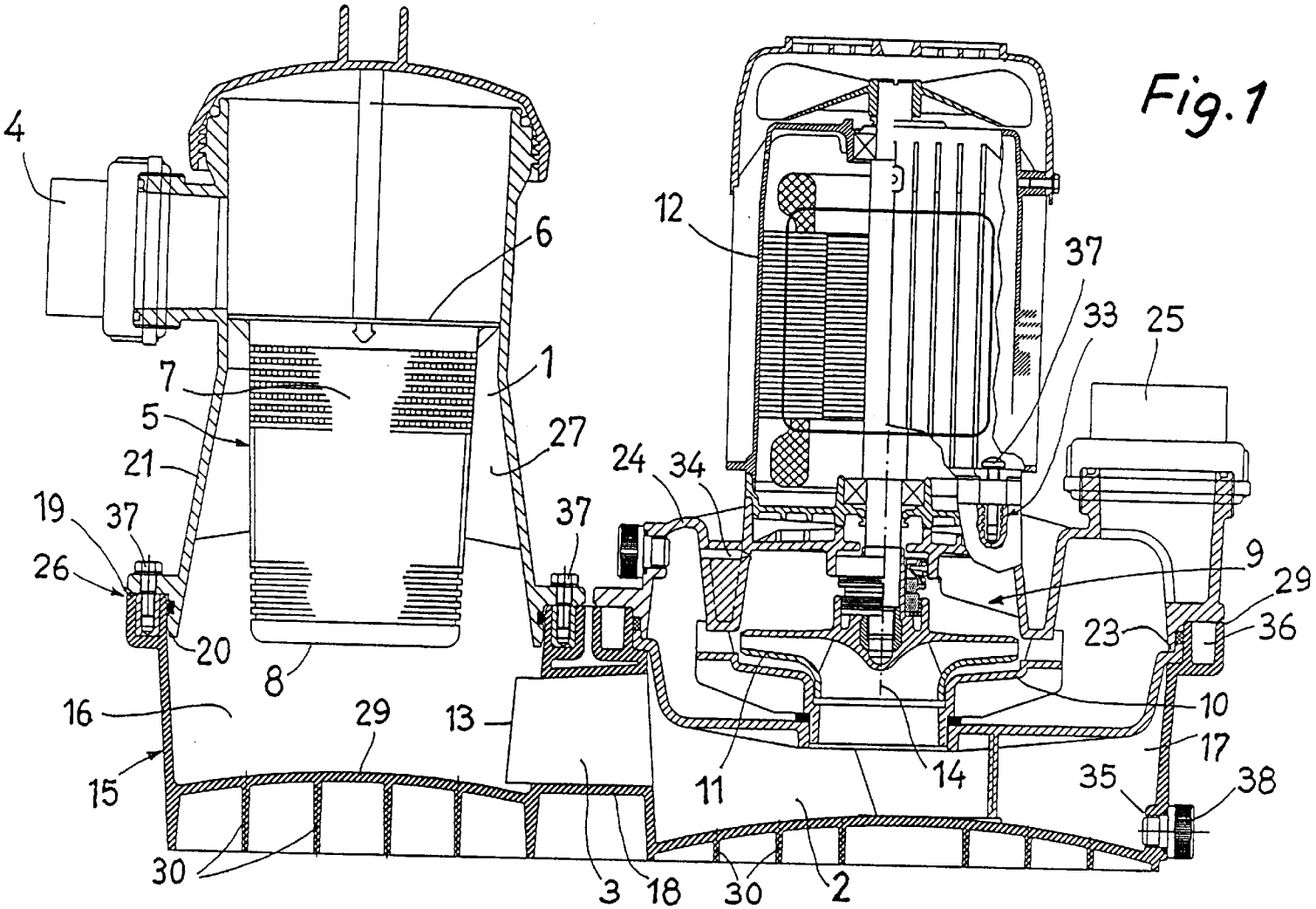
FIG. 1 is a side elevation view in section, of the electric pump of the invention.
Figures 2, 3:
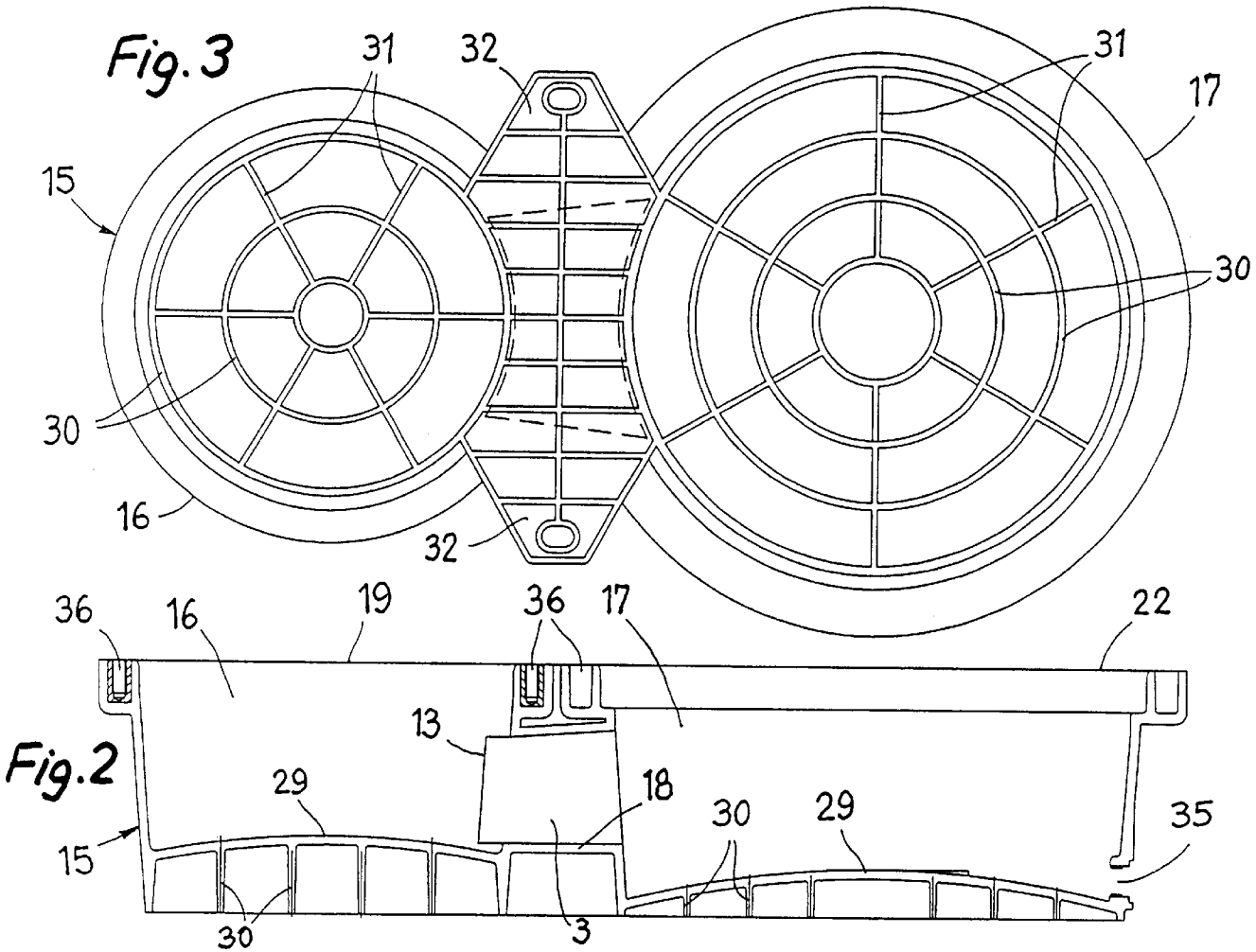
FIG. 2 shows a side elevation view in half-section, of the lower support part.
FIGS. 3 and 4 show respectively a lower plan and a plan diagrammatic view, of the electric pump of FIG. 1.

In said drawings it can be appreciated that the electric pump in question includes a suction chamber 1 and a pressure chamber 2, connected to each other by the communication conduit 3.

The suction chamber 1 is provided with a suction inlet 4, wherein the water to be filtered and driven enters, and a filter vessel 5 in which the water drawn in enters by its upper open inlet 6 and exits by multiple small orifices made in its wall 7 and in its lower base 8.

The pressure chamber 2 includes an impeller assembly 9, driven by a coaxial electric pump 12, and an outlet 25 for the filtered and impelled water.

The communication conduit 3 between the chambers 1 and 2 is arranged at a lower level to that of the lower base 8 of the filter vessel 5, so that the inlet 13 of said conduit 3 in the suction chamber is situated below the mentioned lower base 8 of the filter vessel 5.

An ample hollow space is arranged below the lower base 8 of filter vessel 5 and the impeller assembly 9, which in the case of the electric pump represented in the drawings is made up of several vesselvessels 16, 17. Said extensive space can contain a relatively high volume of water which, once the electric pump has started up for the first time, is permanently housed in said ample hollow space.

The two vessels 16 and 17 are circular in appearance and are solidly joined and communicate with one another by the tubular zone 18, which constitutes the communication conduit 3 between the suction chambers 1 and pressure chamber 2. The assembly of both vessels 16 and 17 is incorporated within a single-piece support 15, which constitutes the electric pump base. Naturally, the mentioned vessels could perfectly well be of a different configuration to that of a circular one, such as, for example, a preferred regular polygonal appearance without going beyond the scope of the invention.

With the vessels 16 and 17 arranged like this under the suction chamber 1 and pressure chamber 2, respectively, and with the hollow space determined thus, it enables a relatively large volume of water to be contained therein which, once the electric pump has started up for the first time, remains permanently housed in said vessels 16 and 17.

So that there is a better circulation of water around the entire filter vessel 5, the body walls 21 of the suction chamber 1 and the walls 7 of the filter vessel 5 diverge appreciably from each other. Thus, a wide annular space 27 is determined between both walls for the water circulation.

The shaft 14 of the electric motor 12 and of the impeller assembly 9 is essentially vertical and said impeller assembly is arranged under the electric motor 12.

The upper mouth 19 of the first vessel 16 is adapted for receiving the support and hermetic slotting of the open lower base 20 of the body 21 of the suction chamber 1. In turn, the upper mouth 22 of the second vessel 17 is adapted for also receiving the support and hermetic slotting of the open lower base 23 of the body 24 of the suction chamber 2.

Figure 4:
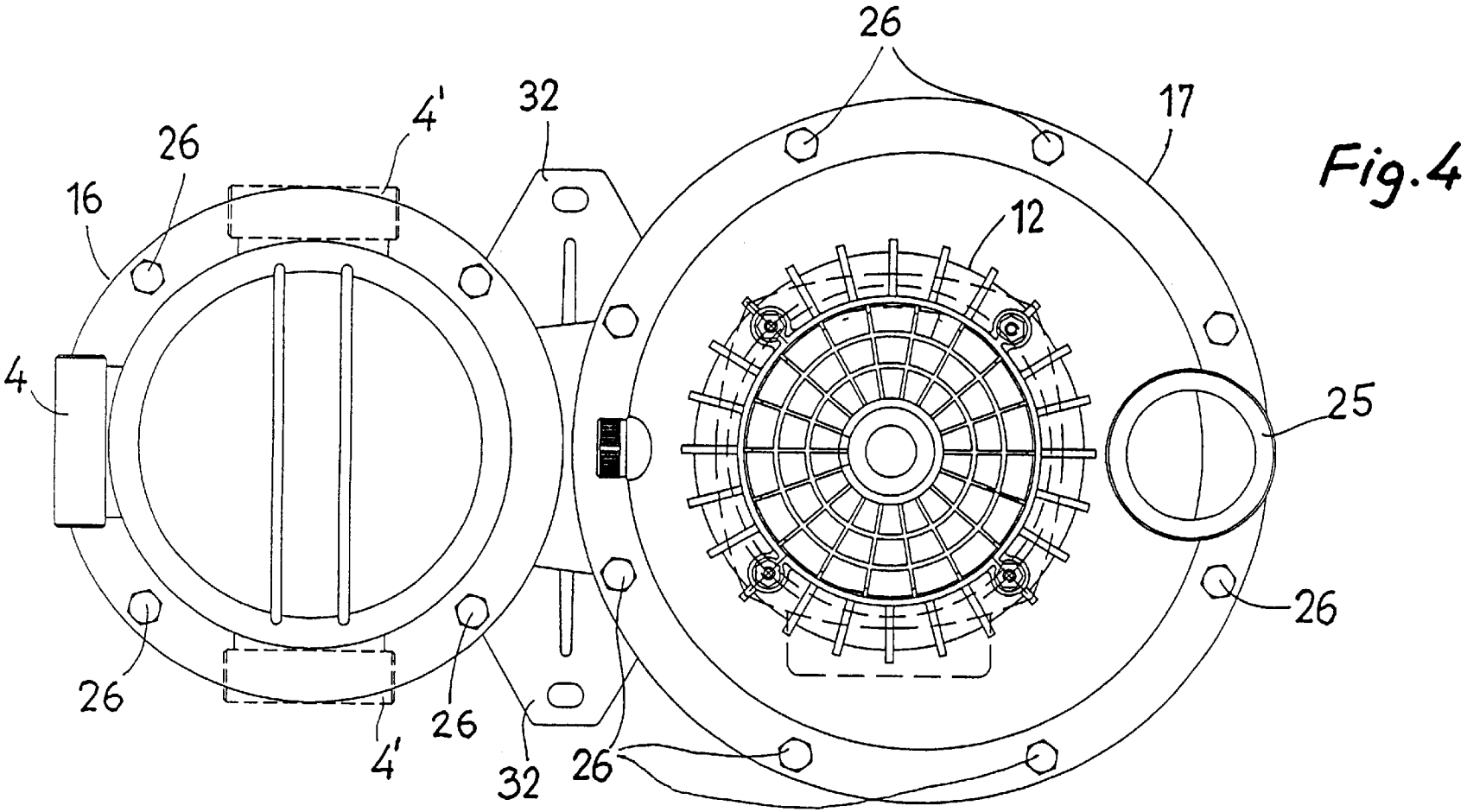

The upper mouths 19 and 22 of the vessels 16 and 17 of the lower support part 15 are provided with a plurality of securing elements 26, made up of internally threaded blind orifices 36 and adapted for securing by means of screws 37 the respective open lower bases 20 and 23 of the bodies 21 and 24 of the suction chamber 1 and pressure chamber 2. Said elements are arranged equidistant to each other, enabling the respective securing in a plurality of different positions of the bodies 21 and 24 over the mouths 19 and 22 of the cubicle 15. Thanks to this, the position of the suction mouth 4 (shown with continuous line in FIG. 4) can be varied and which can also adopt any one of the positions 4' (shown with dashed line in FIG. 4).

In the same way, the pressure inlet 25 will also be able to adopt other positions, not represented.

Likewise, the electric pump 12 cover is joined to the upper part of the body 24 of the pressure chamber 2 by means of a plurality of securing elements 33 which are also equidistant to each other, making it possible to have a corresponding plurality of different positions of said cover in respect of body 24.

The bottom 29 of both cubicles 16 and 17 of the support part 15 is gently convex for the purpose of increasing its resistance to the water pressure while the electric pump is operating. Moreover, under the bottom 29 several circular 30, and radial 31 ribs are arranged and have the function of resting on the ground to strengthen said resistance.

Likewise, the part 15 has several arms 32, also adapted for resting on the ground and easing the emplacement and securing within the electric pump.

Complementarily, the body 24 of the pressure chamber 2 is provided with a micro-orifice 34, adapted for ejecting the air contained in the impelled water which accumulates in the upper part of the pressure chamber 2.

The support part 15 has the advantage of being equipped, in at least one lower peripheral point, with a drain outlet 35, provided with a cover 38 for optionally easing the extraction of the water accumulated in the vessels 16 and 17.

What is claimed is:

1. Electric pump for the re-circulation and filtering of swimming pool water, comprising:

a support part including a first vessel and a second vessel;

a suction chamber (1) including the first vessel and a first body;

and a pressure chamber (2) including the second vessel and a second body, the suction chamber and pressure chamber being connected to one another by a communication conduit (3), wherein said communication conduit (3) being entirely formed as part of said support part, the suction chamber being provided with a water suction inlet (4), wherein the swimming pool water to be filtered and impelled enters, and a filter vessel (5), into which the water drawn in enters by an open upper inlet (6) and exits by multiple small orifices made in its wall (7) and/or lower base (8), whereas the pressure chamber comprises an impelling assembly (9), driven by an electric motor (12), and a water outlet (25) for the filtered and impelled water, characterised in that the said communication conduit between the suction and pressure chambers is arranged at a lower level than the filter vessel lower base, whereby the mouth (13) of said conduit in the suction chamber is situated below the aforementioned filter vessel lower base.

2. Electric pump for the re-circulation of water in accordance with claim 1, characterised in that below the lower base (8) of the filter vessel (5) and the impeller assembly (9) a hollow space (16, 17) is arranged, wherein the hollow space contains a volume of water which, once the electric pump has started up for the first time, remains permanently housed in said ample hollow space.

3. Electric pump for swimming pools in accordance with claim 2, characterised in that the body walls (21) of the suction chamber (1) and the walls (7) of the filter vessel (5) diverge appreciably from one another, so that between both walls a wide space (27) for the circulation of water is determined.

4. Electric pump for the re-circulation and filtering of swimming pool water, comprising:

a suction chamber (1) and a pressure chamber (2), both of which are connected to one another by a communication conduit (3), the suction chamber being provided with a water suction inlet (4), wherein the swimming pool water to be filtered and impelled enters, and a filter vessel (5), into which the water drawn in enters by an open upper inlet (6) and exits by multiple orifices made in its wall (7) and/or lower base (8), whereas the pressure chamber comprises an impelling assembly (9), driven by an electric motor (12), and a water outlet (25) for the filtered and impelled water, characterised in that the said communication conduit between the suction and pressure chambers is arranged at a lower level than the filter vessel lower base, whereby the mouth (13) of said conduit in the suction chamber is situated below the aforementioned filter vessel lower base characterised in that the body walls (21) of the suction chamber (1) and the walls (7) of the filter vessel (5) diverge appreciably from one another, so that between both walls a wide space (27) for the circulation of water is determined.

5. Electric pump for the re-circulation of water in accordance with claim 4, characterised in that below the lower base (8) of the filter vessel (5) and the impeller assembly (9) a hollow space (16, 17) is arranged, wherein the hollow space contains a volume of water which, once the electric pump has started up for the first time, remains permanently housed in said ample hollow space.

* * * * *